United States Patent [19]

Curtis

[11] Patent Number: 4,570,812

[45] Date of Patent: Feb. 18, 1986

[54] RECESSED FLEXIBLE WALL REFUSE CONTAINER

[75] Inventor: Joel E. Curtis, Chickasha, Okla.

[73] Assignee: Southwestern Products, Inc., Norman, Okla.

[21] Appl. No.: 684,436

[22] Filed: Dec. 20, 1984

[51] Int. Cl.[4] ..... B65D 25/18; B65D 25/38; B65D 47/08; B65D 90/04

[52] U.S. Cl. ..... 220/1 T; 220/18; 220/18.1; 220/254; 220/404; 220/408; 220/409

[58] Field of Search ..... 220/1 T, 85 B, 254, 220/408, 404, 410, 403, 409, 18, 401, 18.1; 52/19, 20; 404/25, 26; 294/67 DA, 67 D

[56] References Cited

U.S. PATENT DOCUMENTS

| | | | |
|---|---|---|---|
| 607,524 | 7/1898 | Reed | 220/409 |
| 1,009,842 | 11/1911 | Jones | 220/254 |
| 1,011,874 | 12/1911 | Stephenson | 220/254 |
| 1,131,102 | 3/1915 | Aldrich | 220/1 T |
| 1,317,045 | 9/1919 | Shawley | 220/254 |
| 1,421,628 | 7/1922 | Watkins | 220/402 X |
| 3,286,878 | 11/1966 | Schadt et al. | 220/85 B |
| 3,321,103 | 5/1967 | Phillips | 220/404 |
| 3,385,011 | 5/1968 | Sorrell | 52/19 |
| 3,688,933 | 9/1972 | Rumell | 294/67.33 |
| 3,800,973 | 4/1974 | Weaver | 220/409 |
| 3,915,329 | 10/1975 | Zaks | 220/404 |
| 4,040,461 | 8/1977 | Carson | 220/401 X |
| 4,140,257 | 2/1979 | Peterson | 220/404 X |

FOREIGN PATENT DOCUMENTS

| | | | |
|---|---|---|---|
| 1104447 | 4/1961 | Fed. Rep. of Germany | 404/25 |
| 17379 | 6/1905 | United Kingdom | 404/25 |

*Primary Examiner*—Allan N. Shoap
*Attorney, Agent, or Firm*—Robert K. Rhea

[57] ABSTRACT

A community refuse receptacle including a flexible wall container secured at its open end in depending relation to the bottom surface of a cover overlying a well in the surface of the earth. The cover is provided with a central opening opened and closed by a hingedly connected lid. A pair of horizontally disposed tubular members are connected with the cover at opposing edges of the lid. The tubes receive lifting arms of a commercial waste disposal unit for lifting and inverting the container in an emptying action wherein the lid falls by gravity to an open position. Wall stabilizing, members depending from the lid, prevent collapse of the container when inverted.

3 Claims, 2 Drawing Figures

RECESSED FLEXIBLE WALL REFUSE CONTAINER

BACKGROUND OF THE INVENTION

1. Field of the Invention

The present invention relates to refuse containers and more particularly to a jumbo size recessed refuse container.

Garbage cans or refuse containers, even with lids in place, placed adjacent a curb for pickup and emptying are subject to being overturned by the wind or animals and the garbage or trash is strewn over the landscape.

This invention eliminates such unsightly and unsanitary results.

2. Description of the Prior Art

It is known to recess a housing or shell into the surface of the earth for surrounding all or the major portion of a container with its lid adjacent the surface of the earth, however, this has the disadvantage of necessitating manually lifting a filled container out of the recess in order to properly dispose of the refuse therein. It is also known to employ a manually operated lever arrangement to lift or at least partially lift the container out of its well. However, such devices have not come into general use principally for the reason, it is believed, they have not been too successful in operation and maintenance.

This invention provides a relatively large container capable of receiving a quantity of refuse equal to several home owner refuse containers of conventional dimensions. Further, this container is recessed into the surface of the earth and includes horizontal lifting tubes projecting above the surface of the earth to be received by a mobile power operated refuse collecting unit for lifting the container, emptying and returning it to its position in its surrounding well.

SUMMARY OF THE INVENTION

A generally cylindrical flexible wall refuse container having one end closed and having its other end secured to a planar cover is loosely contained by an upwardly open recess or well formed in the surface of the earth. The wall forming the well is reinforced with suitable wall material and provided with a moisture absorbing inner liner or bottom for the well. The major portion of the cover defines an opening opened and closed by a hingedly connected lid. The lid generally supports a trap door of substantially smaller dimension than the lid. The cover is further provided with a pair of parallel spaced-apart horizontal open end channels or tubes for receiving the lifting arms of a refuse pickup and disposal apparatus.

The principal object of this invention is to provide a relatively large capacity flexible wall refuse container removably received by a well formed in the surface of the earth which includes a refuse cover for sealing the container and in which door and lid members provide access for depositing refuse therein including arm receiving socket members for lifting, emptying and returning the container to its well.

DESCRIPTION OF THE PREFERRED EMBODIMENTS

Figure 1:
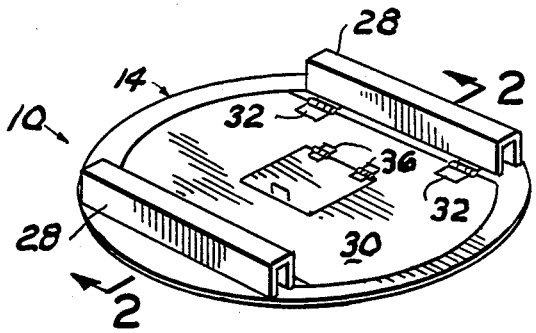
FIG. 1 is a perspective view of the installed refuse container.
Figure 2:
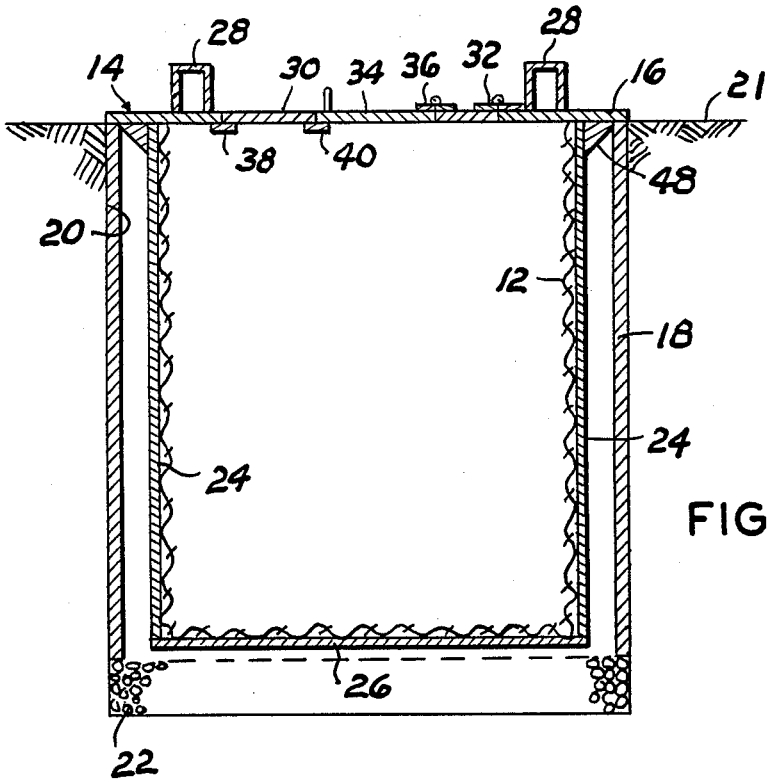
FIG. 2 is a vertical cross sectional view, to a larger scale, taken substantially along the line 2—2 of FIG. 1.

Like characters of reference designate like parts in those figures of the drawings in which they occur.

In the drawings:

The reference numeral 10 indicates the device, as a whole, which is generally cylindrical in overall configuration. The device 10 includes a flexible wall sack-like container 12 having its open end secured to a planar top or cover 14. The cover 14 is shown circular but obviously may be of other configuration, such as rectangular, if desired. The container 12 is connected to the cover 14 inwardly of its perimeter to define a circumferential flanged edge 16 of the cover which overlies, at its marginal edge portion, the upper limit of a retaining wall 18 lining a recess or well 20 formed in the surface 21 of the earth. The recess 20 is diametrically greater than the diameter of the flexible container 12 for loosely receiving the container. The bottom of the well may be provided with a layer of gravel 22, or the like, to enhance drainage of any liquids. The wall of the flexible container is attached to and supported by stabilizer members 24 which depend from the inner surface of the cover 14 and terminate in spaced relation with respect to the bottom of the well.

The stabilizer 24 may be a plurality of elongated panels or rods, as desired. In either event the depending ends of the stabilizers are transversely innerconnected below the bottom of the flexible container as by rods 26 for the purpose of preventing lateral movement of the stabilizers in opposing direction which could diametrically enlarge the depending end portion of the flexible container and hamper its removal and insertion from and to the recess 20, as presently explained.

A pair of elongated channel members or tubes 28 are secured to the top surface of the cover 14 in parallel spaced-apart diametrically opposite relation for longitudinally receiving parallel cooperating lifting arms of a conventional hydraulically operated waste container and disposal unit usually mounted on a self-propelled vehicle, not shown. Between the tubular members 28, the cover is centrally apertured and closed by a lid 30 connected by hinges 32 with the cover adjacent one of the members 28 for vertical pivoting movement, for the purposes presently explained.

The lid 30 is centrally provided with a reduced size trap door 34 similarly hingedly connected, as at 36, with the lid for vertical pivoting movement. The purpose of the trap door 34 is to permit individuals to deposit refuse in the container without the necessity of opening the lid 30. Both the lid 30 and the trap door 34 are supported in the plane of the cover 14 when in closed position by a pair of keepers 38 and 40 underlying and secured respectively to the cover 14 and lid 30 opposite the respective hingedly connected edge thereof.

OPERATION

In operation, the device 10 is installed in the recess 20 in the earth as described hereinabove and is progressively filled by placing refuse therein through the trap door 34. The device 10 is emptied by the above described mobile disposal lifting unit which picks up the device 10 by the tubular members 28 and inverts the device 10 over the waste receiving disposal unit. The elongated tubes 38, surrounding cooperating lift arms, maintain the plane of the cover horizontal when inverted. The lid 30 falls by gravity to an open position permitting substantially all refuse contained by the flexible container 12 to fall by gravity into the disposal unit. The stabilizers 24 prevent the flexible sack 12 from collapsing upon itself thus insuring that all refuse will fall out of the device opening defined by the lid 30. The disposal unit then replaces the device 10 in the earth recess 20 wherein a continuous or plurality of gussets 48 underlying the cover flanged edges 16 guides the cover to a central position with respect to the earth recess 20 by contact with the upper limit of the retaining wall 18.

Obviously the invention is susceptible to changes or alterations without defeating its practicability. Therefore, I do not wish to be confined to the preferred embodiment shown in the drawings and described herein.

I claim:

1. A concealed refuse container, comprising:

a planar cover adapted to overly and close an upwardly open well formed in the surface of the earth, said cover having a central opening;

lid means for normally closing the central opening;

a pair of tubular members horizontally secured in overlying parallel spaced-apart relation to diametrically opposite edge portions of said cover;

a flexible wall container depending from said cover and substantially filling the well, said container having a wall and having an open end communicating with the lid closed cover opening;

container wall stabilizer means including vertically oriented elongated members substantially coextensive with the depth of the well depending from said cover for preventing inward collapse of said flexible wall when said cover is inverted; and, means horizontally interconnecting the ends of said elongated members opposite the cover.

2. The container according to claim 1 and further including:

a retaining wall defining the inner perimeter of the well; and, guide means including a gusset secured to the depending surface of said cover outwardly of said elongated members for contacting the upper limit of said retaining wall and centering the flexible wall container in the earth well.

3. The container according to claim 2 in which said lid is provided with an opening and further including:

a trap door hingedly connected with said lid for opening and closing the lid opening.

* * * * *